US007268735B2

(12) United States Patent
Chung

(10) Patent No.: US 7,268,735 B2
(45) Date of Patent: Sep. 11, 2007

(54) ANTENNA STRUCTURE

(76) Inventor: Chin-Yuan Chung, No. 20, Lane 222, Sanfu St., Changhua City, Changhua County 500 (TW)

( * ) Notice: Subject to any disclaimer, the term of this patent is extended or adjusted under 35 U.S.C. 154(b) by 0 days.

(21) Appl. No.: 11/315,374

(22) Filed: Dec. 23, 2005

(65) Prior Publication Data

US 2007/0146220 A1 Jun. 28, 2007

(51) Int. Cl.
*H01Q 11/12* (2006.01)

(52) U.S. Cl. ..... 343/741; 343/866
(58) Field of Classification Search ..... 343/741, 343/742, 866, 867
See application file for complete search history.

(56) References Cited

U.S. PATENT DOCUMENTS

| | | | | |
|---|---|---|---|---|
| 3,508,274 | A * | 4/1970 | Hurtig et al. | 343/758 |
| 3,739,388 | A * | 6/1973 | Callaghan | 343/726 |
| 4,518,965 | A * | 5/1985 | Hidaka | 343/742 |
| 6,054,963 | A * | 4/2000 | Muterspaugh | 343/741 |
| 6,429,828 | B1 * | 8/2002 | Tinaphong et al. | 343/824 |

* cited by examiner

*Primary Examiner*—Tho Phan
(74) *Attorney, Agent, or Firm*—Troxell Law Office, PLLC

(57) ABSTRACT

An antenna structure is composed of an antenna seat, a terminal, and an antenna set. The antenna set includes antennae, a matching circuit, conducting wires, and a lead wire. By the conducting wires and matching circuit connected on the antennae, an impedance matching can be achieved to be coupled with frequency of radio wave signal to be received for reducing a standing-wave ration, when the antenna are receiving the radio wave signal. In addition, the frequency and wavelength of radio wave signal received by the antennae can be adjusted by changing lengths of conducting wires.

5 Claims, 8 Drawing Sheets

ANTENNA STRUCTURE

BACKGROUND OF THE INVENTION (a) Field of the Invention

The present invention relates to an antenna, and more particularly to an improved antenna structure.

(b) Description of the Prior Art

Referring to FIG. 1, an ordinary antenna device A includes an antenna seat A1 on which installed with disks A2 and a retractable antenna A3. As radio wave signal is provided with directivity, direction of disks A2 should be adjusted to find an optimal receiving position when the disks A2 are receiving UHF (Ultra High Frequency) radio signal.

In addition, when the retractable antenna A3 is receiving VHF (Very High Frequency) radio signal, an angle of the retractable antenna A3 should also be adjusted to achieve a best receiving effect.

SUMMARY OF THE INVENTION

The present invention is to provide an improved antenna structure wherein a conducting wire and a matching circuit are connected to an antenna, such that an impedance matching can be achieved and a better coupling with a frequency of radio wave signal to be received can be available when the antenna device is receiving the radio wave signal.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
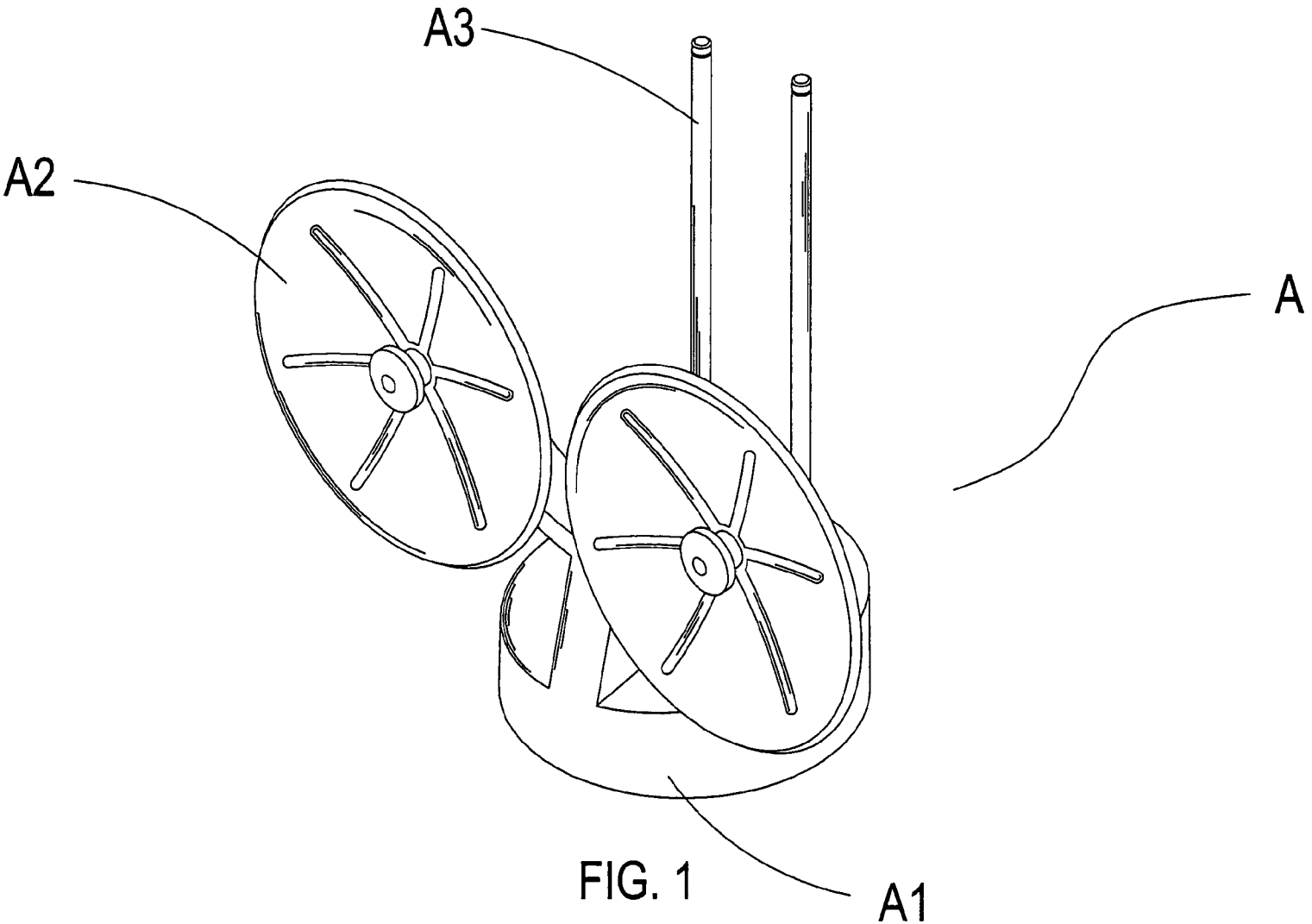
FIG. 1 Prior Art
FIG. 1 shows a perspective view of a conventional application.
Figure 2:
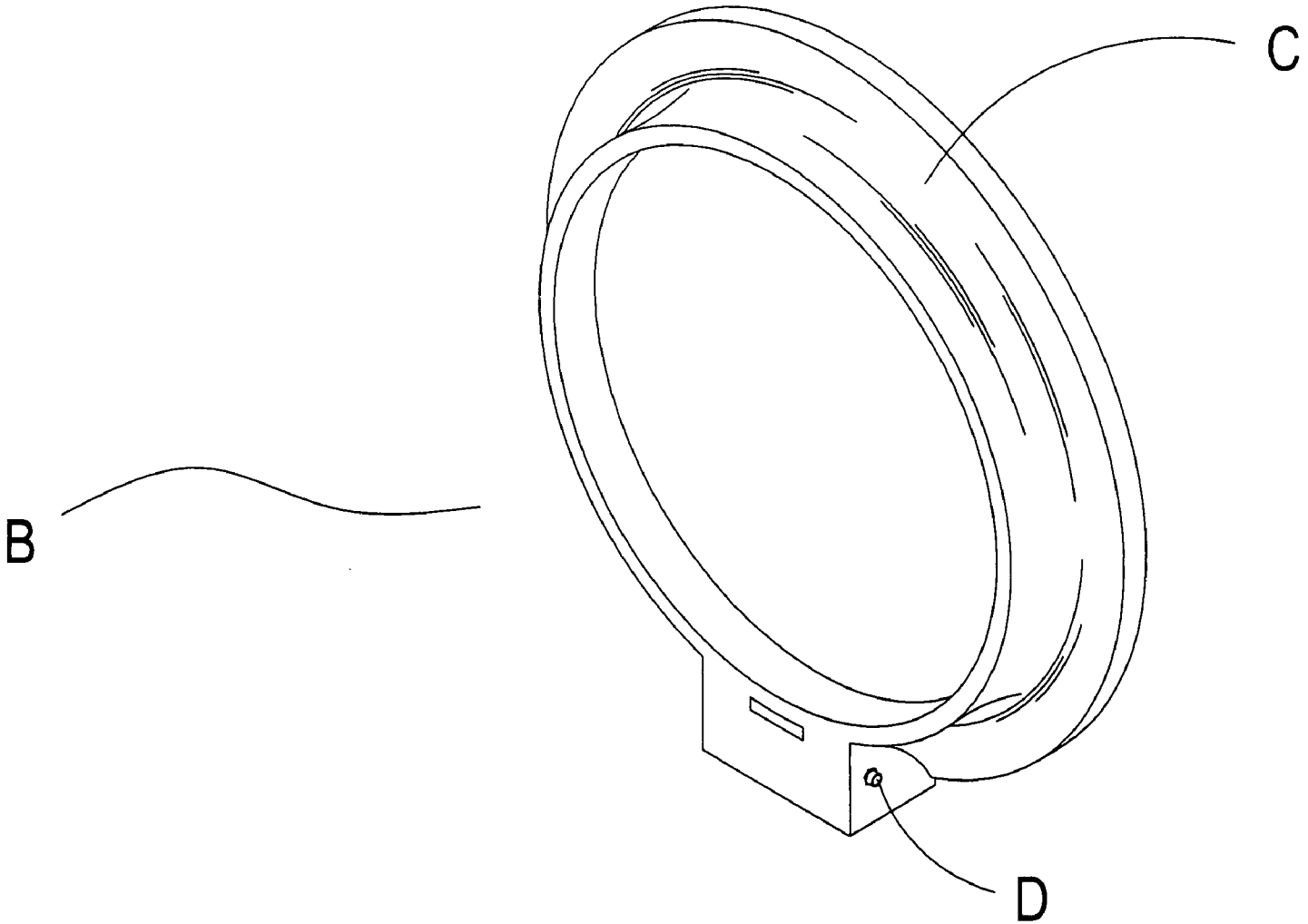
FIG. 2 shows a perspective view of the present invention.
Figure 3:
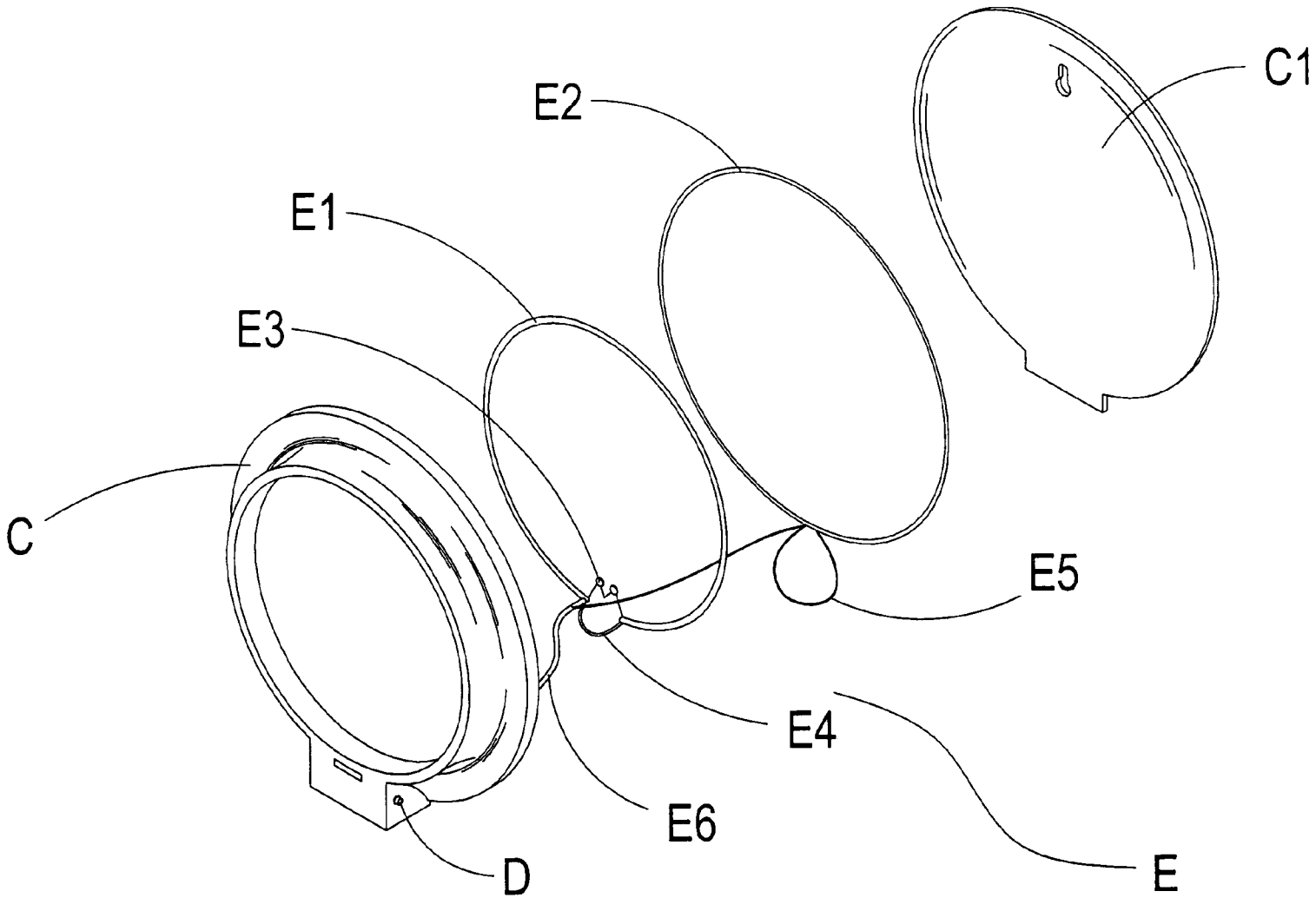
FIG. 3 shows a perspective view of components of the present invention before being assembled.

Referring to FIG. 2 and FIG. 3, an antenna device B of the present invention comprises an antenna seat C, a terminal D, and an antenna set E, wherein the antenna seat C is provided with the terminal D and contains the antenna set E. A seat cover C1 is located at one side of the antenna seat C for hiding and fixing the antenna set E in the antenna seat C.

The antenna set E includes antennae E1, E2, a matching circuit E3, conducting wires E4, E5, and a lead wire E6, wherein the conducting wires E4, E5 are electrically connected to the antennae E1, E2, the matching circuit E3 is connected to the antenna E1, and the antennae E1, E2 are connected to one end of the lead wire E6 whose other end is connected to the terminal D.

The conducting wire E4 and the matching circuit E3 allow the antenna E1, E2 to achieve an impedance matching in receiving radio wave signal, and enable a coupling with a frequency of received radio wave signal and a reduction of a standing-wave ratio. Furthermore, by changing a length of the conducting wire E4, a frequency and wavelength of the radio wave signal to be received by the antennae E1, E2 can be adjusted.

Figure 4:
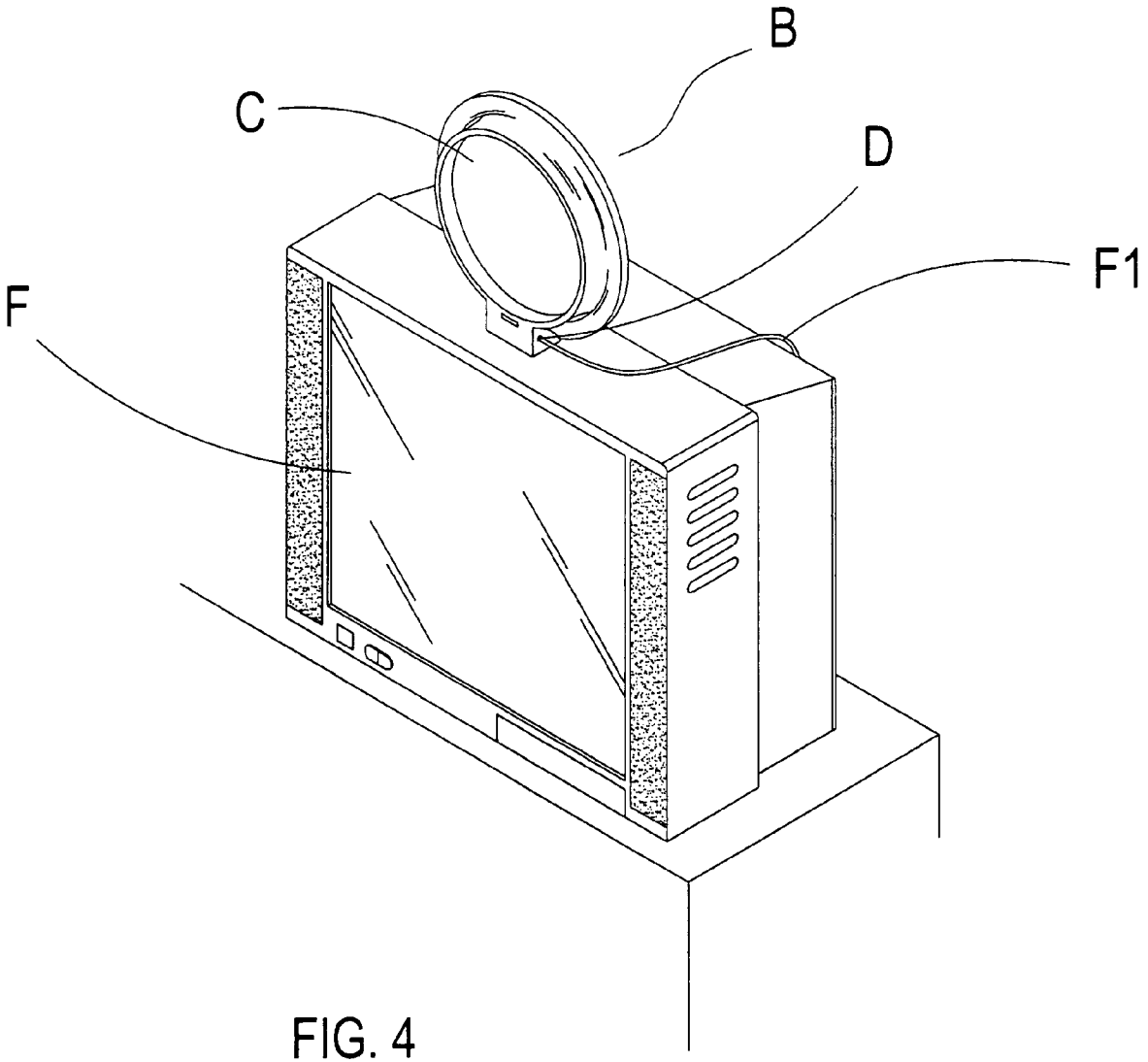
FIG. 4 shows a schematic view of an implementation of the present invention.

Referring to FIG. 3 and FIG. 4, when the antennae E1, E2 of antenna set E in the antenna seat C are receiving the radio wave signal, the impedance matching can be achieved by the connected matching circuit E3 and conducting wires E4, E5, so as to couple with the frequency of radio wave signal to be received for reducing the standing-wave ratio. The lead wire E6 is then connected to the antennae E1, E2 for an electric connection between the terminal D, and the seat cover. C1 is covered at one side of the antenna seat C for hiding and fixing, wherein the lengths of conducting wires E4, E5 can be changed, so as to adjust the frequency and wavelength of radio wave signal to be received by the antennae E1, E2.

Figure 5:
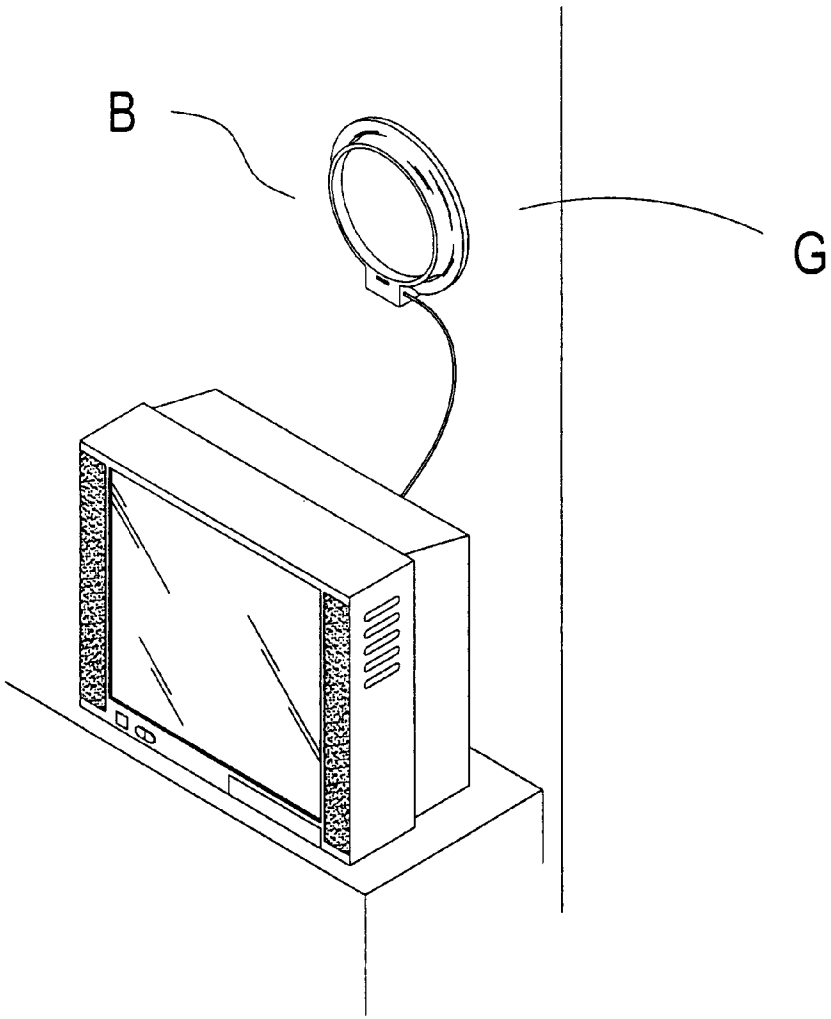
FIG. 5 shows a schematic view of a second implementation of the present invention.

The antenna device B is installed on a television (TV) set F, and a signal line F1 is used to connect the terminal D and the TV set F, followed by receiving the radio wave signal through the antenna set E in the antenna seat C, so as to provide a best digital and analog definition to the TV set F. In addition, as shown in FIG. 5, the antenna device B can be also put on a wall G for application.

Figure 6:
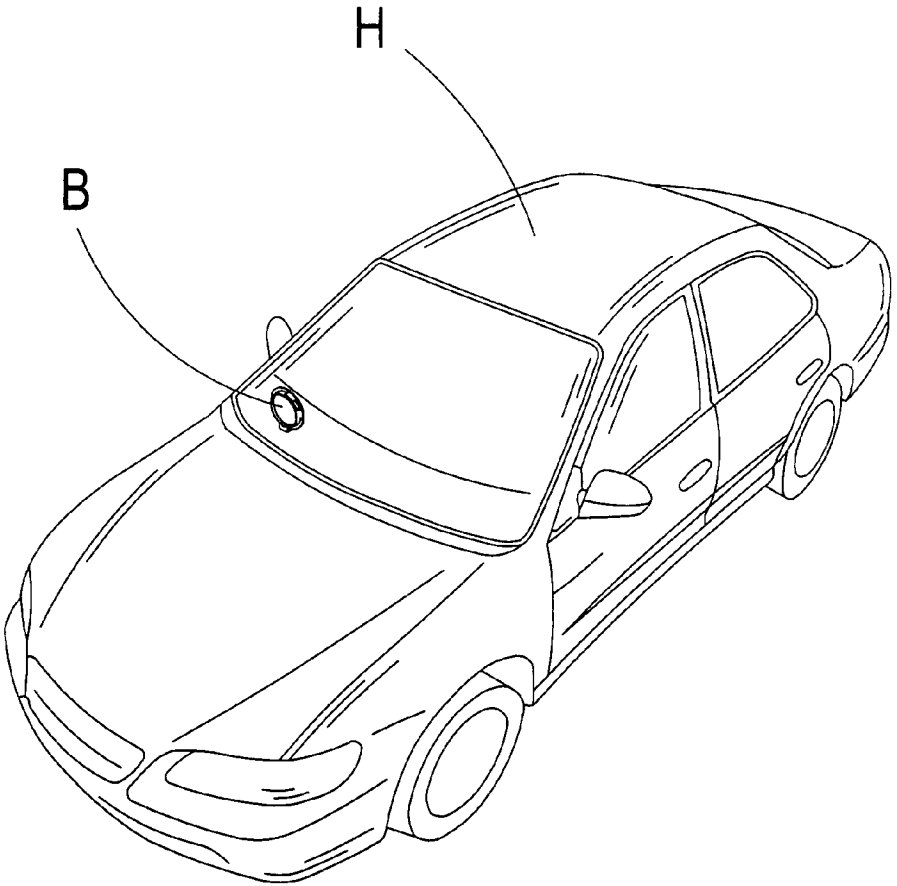
FIG. 6 shows a schematic view of a third implementation of the present invention.
Figure 7:
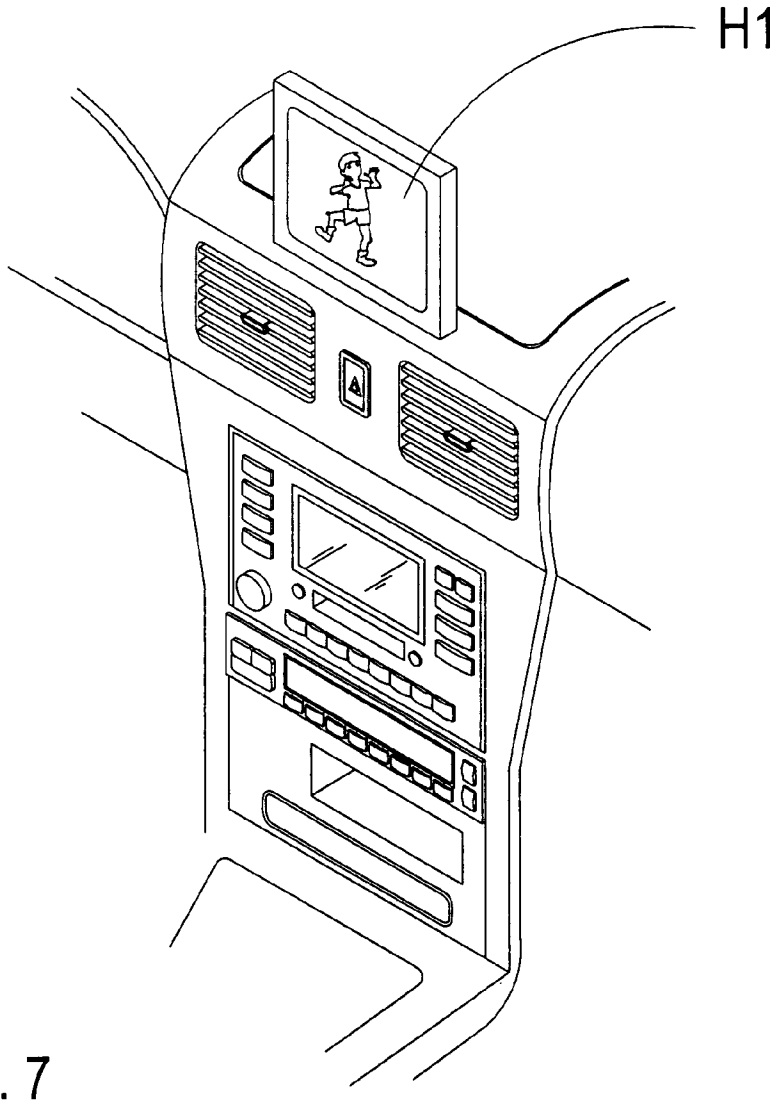
FIG. 7 shows a schematic view of a fourth implementation of the present invention.

Referring to FIG. 6 and FIG. 7, an appearance of antenna device B can be changed according to environment of application. When the antenna device B is installed in a transportation vehicle H for providing an audio/video equipment H1 to receive radio wave signal, a quality of radio wave signal to be received by the antenna device B will not be affected by a motion of the transportation vehicle H, so as to enable a driver and passengers to enjoy a best audio/video effect.

Figure 8:
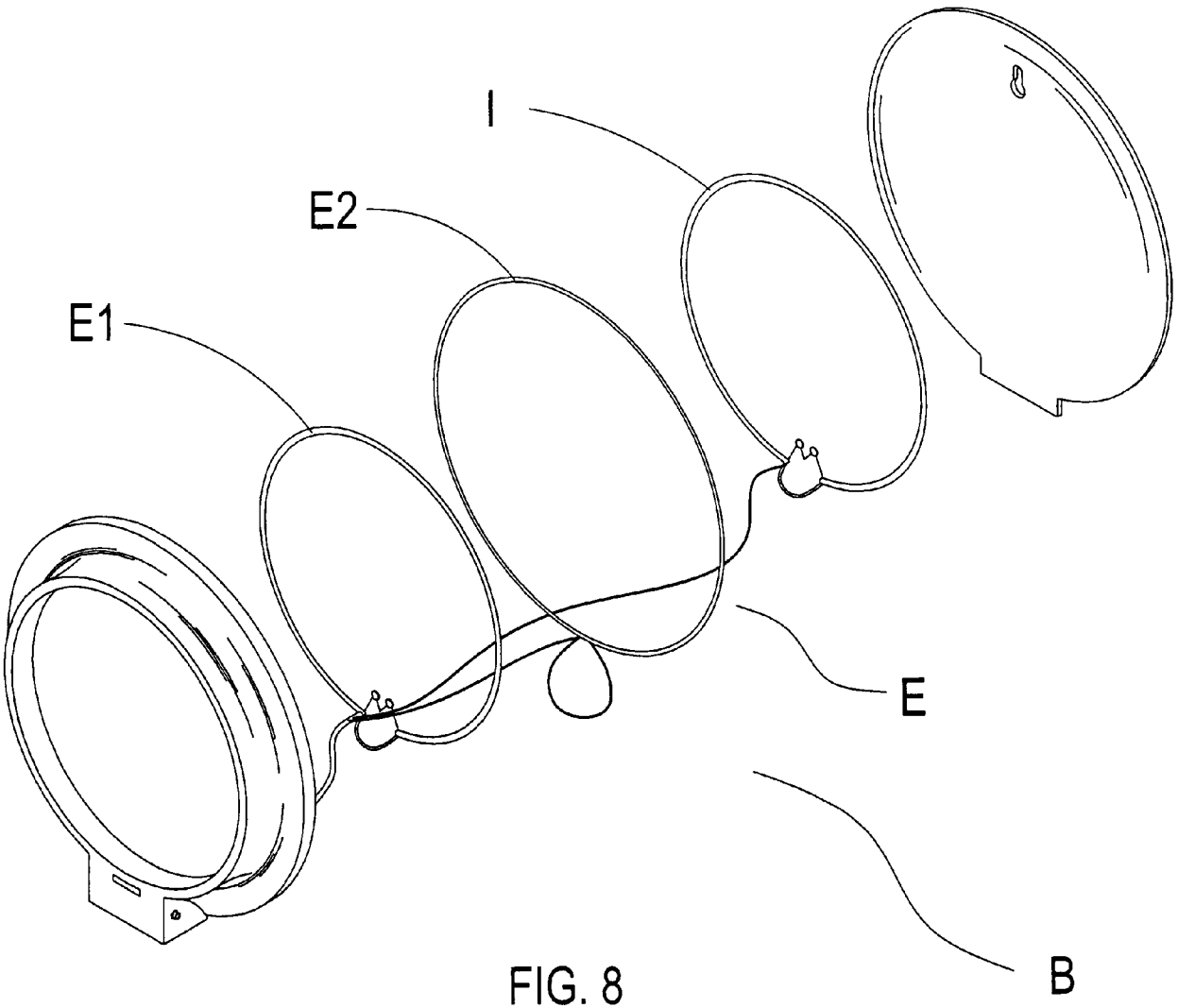
FIG. 8 shows a schematic view of a further implementation of the present invention.

Referring to FIG. 8, the antenna set E is further provided with at least three antennae E1, E2, I, such that the antenna device B becomes a multi-ring signal reception set, in order to enhance an effect of receiving the radio wave signal.

To further manifest the advancement and practicability of the present invention, the advantages of the present invention are listed below:

1. It can receive signal without adjusting a position and direction.
2. The signal received will not be affected by a change of position and direction.
3. It is provided with a simple structure.
4. The UHF (Ultra High Frequency) signal and VHF (Very High Frequency) signal can be received at the same time.
5. It can receive a better signal, just like a conventional outdoor antenna.
6. The impedance matching can be better coupled with frequency of radio wave signal to be received.
7. It is provided with a broader range of application.
8. It is provided with an industrial competitiveness.
9. It is provided with a commercial value.
10. It is provided with advancement.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. An antenna structure comprising an antenna seat which is provided with a terminal and a n antenna set, with a seat cover at one side of the antenna seat for fixing, wherein the antenna set includes antennas, a matching circuit, conducting wires, and a lead wire, with an improvement that the conducting wires and matching circuit are connected to the antennas such that when the antennae are receiving radio wave signals, an impedance matching can be achieved by an electric connection fo the conducting wires and matching circuit for being coupled with frequency of radio wave signal to be received to reduce a standing-wave ratio, the frequency and wavelength of radio wave signal to be received by the antennae can be adjusted by changing lengths of said conducting wires.

2. The antenna structure according to claim 1, wherein the antenna structure is further applied to a TV set, a radio, and other equipment related to receiving the radio wave signal.

3. The antenna structure according to claim 1, wherein the antenna is in a ring body for facilitating a reception in a larger area, so as to enhance a strength of radio wave signal to be received.

4. The antenna structure according to claim 3, wherein the body of said antenna is further a polygon body, an oval body, a curved body, and other related body of geometric figure.

5. The antenna structure according to claim 1, wherein two or more than two antennae are included in the antennas set.

* * * * *